US010292544B1

(12) United States Patent
Bonner et al.

(10) Patent No.: US 10,292,544 B1
(45) Date of Patent: May 21, 2019

(54) DR. TINKLE'S POTTY PAL (ELECTRONIC TOILET PAPER DISPENSER)

(71) Applicants: Amber Bonner, New York, NY (US); Michelle D Davis, Simi Valley, CA (US)

(72) Inventors: Amber Bonner, New York, NY (US); Michelle D Davis, Simi Valley, CA (US)

( * ) Notice: Subject to any disclaimer, the term of this patent is extended or adjusted under 35 U.S.C. 154(b) by 127 days.

(21) Appl. No.: 15/090,379

(22) Filed: Apr. 4, 2016

(51) Int. Cl.
*A47K 10/38* (2006.01)
*A47K 10/32* (2006.01)

(52) U.S. Cl.
CPC ..... *A47K 10/38* (2013.01); *A47K 2010/3233* (2013.01); *A47K 2010/3246* (2013.01); *A47K 2010/389* (2013.01)

(58) Field of Classification Search
CPC ..... A47K 10/38; A47K 2010/389
See application file for complete search history.

(56) References Cited

U.S. PATENT DOCUMENTS 3,554,456 A * 1/1971 Moore ..... A47K 10/40 211/6
6,422,503 B1 * 7/2002 Hoo Kong ..... A47K 10/22 242/559.4
7,278,604 B1 * 10/2007 Constantino ..... A47K 10/38 242/403
7,882,968 B2 * 2/2011 Galt ..... A47K 13/06 211/106.01
2007/0262088 A1 * 11/2007 Nanda ..... A47K 10/421 221/305
2011/0046911 A1 * 2/2011 Studer ..... A47K 5/1217 702/108
2014/0033557 A1 * 2/2014 Jefferson ..... D21H 27/002 34/95
2015/0164291 A1 * 6/2015 Bethel ..... A47K 10/38 242/598

* cited by examiner

*Primary Examiner* — Christopher R Harmon

(57) ABSTRACT

Dr. Tinkle's Potty Pal is an electronic toilet paper dispenser for ages 2+. The invention is configured to freely stand within a home restroom and provide interactive learning to a child while seated on the toilet. Power is preferably provided by a lithium battery for long-term use. Once powered on, interactivity of the device is preferably triggered by motion sensor. The interactivity preferably includes flashing lights, sounds and music to entertain the user while learning. All mechanics/electronic components, as well as, the toilet paper roll is preferably housed within the locked top cabinet (or head) of the product. A height controllable stand is used to allow for preferred height placement, and a preferably round base is used for stability and secure placement.

1 Claim, 7 Drawing Sheets

DR. TINKLE'S POTTY PAL (ELECTRONIC TOILET PAPER DISPENSER)

BACKGROUND

This invention relates to the fields of "potty" training, as well as, toilet paper usage control, targeted towards children.

There are various types of toilet paper guards and savers on the market. Most of these are targeted toward abuse of toilet paper by pets or the misuse of toilet paper by small children. All are simple devices that attach to the toilet paper roll and either lock or obstruct the unravelling of toilet paper onto the floor and the general destruction of the roll. Currently, these products require constant locking and unlocking by adults, as they are affixed to a wall dispenser, or toilet paper stand. Some of the existing complaints include everything from these products being cumbersome (e.g. relating to clicking and unclicking to allow adults to freely use), to these products being unsanitary because they are constantly being touched before and after use. Also, if an older child or adult forgets to reapply the stopper to the toilet paper roll after use, they risk a toddler (or pet) coming into the bathroom and unraveling the paper before it can be affixed again.

This invention seeks to provide an easy to use and eye-catching training tool, that will not only teach young children the proper toilet paper usage but, will make that task fun and easy to learn.

BRIEF SUMMARY OF THE INVENTION

The present invention is a toilet paper dispenser that will allow for touchless or minimal touch distribution of the appropriate amount of toilet paper required for the various levels of bathroom use. This intended use of this invention is by children, ages 2+ while they are seated on the toilet for use. This invention includes a motion sensor that will detect the user and allow for interaction with the product. With swiping movements in front of the product sensor or button push functionality, a user can indicate what their intended bathroom usage and the appropriate amount of toilet paper sheets will be dispensed. The present invention will include lights, sounds and music that will play upon the product being "woken up" or turned on. These cues will be used to instruct the user and entertain while in use.

Additional control features will be added to the device, allowing the parent or guardian to apply specific settings for usage. This includes power switch, volume switch, language switch, height control and battery. Each to be controlled individually based on personal preferences. The present invention will also be constructed of a durable, and easy-to-clean material.

REFERENCE NUMERALS IN THE DRAWINGS

Figure 1:
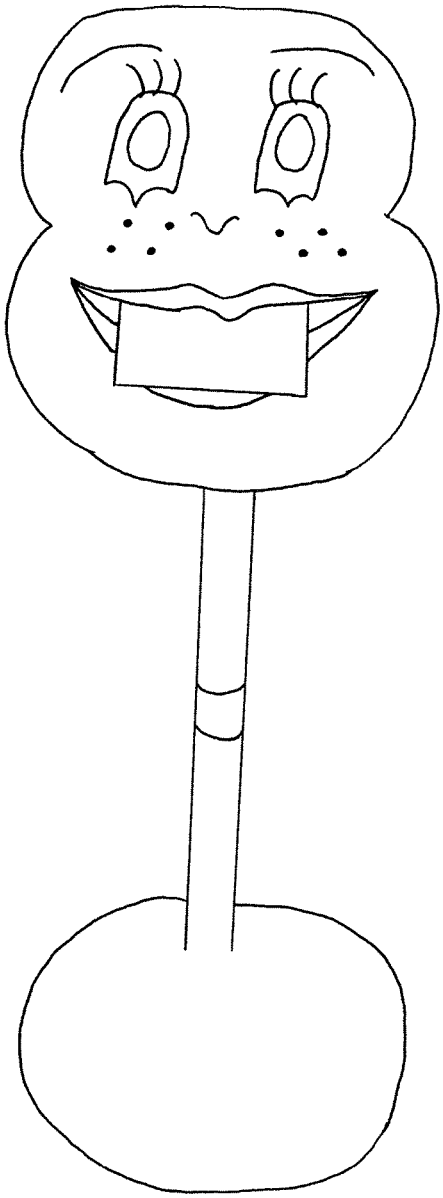
FIG. 1.—presents the perspective view of the full present invention.

1. Motion Sensor and light show
2. Audio speakers (freckles)
3. Toilet paper dispenser (exit)
4. Interactive push buttons (alternate)
5. Back panel
6. Power On/Off button
7. Language switch
8. Audio On/Off switch
9. Battery compartment
10. Stand insert compartment
11. Open/close clasp lock
12. Swivel hinges
13. Toilet paper holder compartment
14. Toilet paper roller
15. Height control stand
16. Stabilizer base (removable)

DETAILED DESCRIPTION AND BEST MODE OF IMPLEMENTATION

FIG. 1 presents the perspective view of the present invention as it would look in an assembled state. This is a fully electronic product with multiple levels of functionality and operational control. The product will be made of shock-proof, child-proof, non-toxic foam, rubber or plastic to prevent damage and allow for easy clean up and sanitation. In addition, the final product will be offered in a series of colors.

Figure 2:
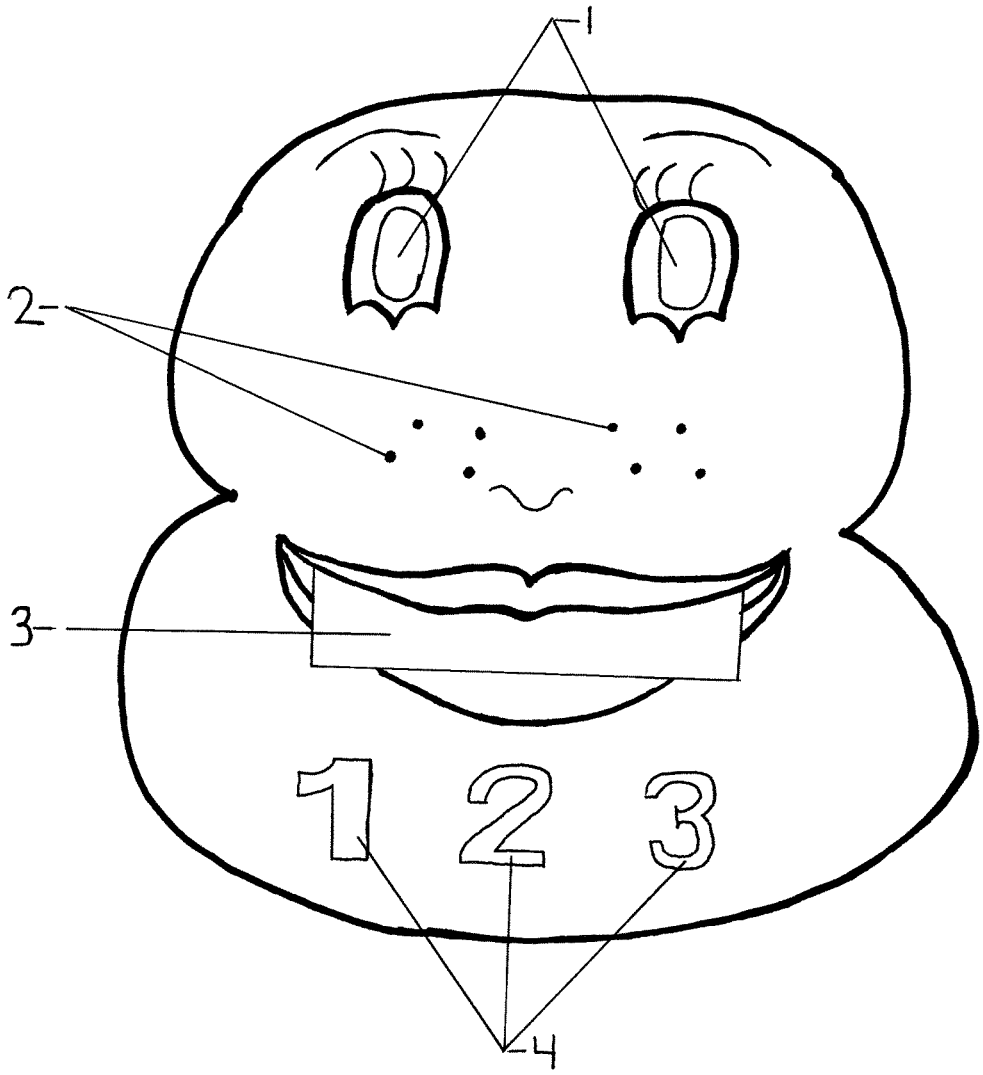
FIG. 2—illustrates the FRONT views of the product top (or head) showing all interactive functionality. Includes alternative 1-2-3 interactive button operation.

FIG. 2 contains all of the interactive portions of the product. Starting with face portion of the top (or head), the eyes (1) will contain a motion sensor within the black pupil area. This motion sensor will detect when a user is present and will automatically wake up from sleep mode (only when the power switch is left ON). Upon turning on, there will be a series of colored lights which will flash through the white areas of the eyes. At the same time, there will be a short melody that will play through the audio speakers (2) located behind the freckles on the face. These lights and sounds will indicate to the user, that the product is on and ready for use. If the dispenser is powered off, the user (or guardian) must first push the power on button (6), located underneath the head, thus triggering the motion sensor, lights and sounds and usage readiness in a matter of seconds.

Once ready for use, to trigger the toilet paper dispenser, the user must indicate what level of bathroom use is intended with hand movements. For example, with children, the intended uses would correlate with a "number 1" indicating urination or, a "number 2" indicating a bowel movement. Preferably, one hand swipe motion in front of the sensor (indicating urination) will trigger the product to electronically dispense 4 sheets of toilet paper from the mouth (3) of the product. As toilet paper dispenses, a short melody will play (and the eyes may light up). Similar methodology is applied to two hand swipe movements in front of the sensor (indicating a bowel movement). Upon two hand swipes, the product will electronically dispense up to 7 sheets of toilet paper from the mouth of the product. As toilet paper dispenses, a short melody will play (and the eyes may light up). Further testing will determine if the number of sheets for both indicators should be increased. Lastly, if extended use is indicated with three hand movements in front of the sensor, then additional sheets of paper will be provided (TBD additional number of sheets based on testing) and a short melody will play (and the eyes may light up). To control overuse of the toilet paper, additional motions beyond the three swipes within this time period will trigger the dispenser to temporarily lock. After a couple minutes of undetected motion, the dispenser will unlock and reset itself for the next user.

There is alternate functionality being considered, as seen in the ALT image. In this version, the motion sensors in the eyes will be used to detect the presence of a user only and wake the dispenser from sleep mode. For toilet paper dispensing triggers, there will be a series of buttons (4) shown as 1-2-3, used to indicate the intended type of bathroom usage. Upon pressing the number 1 (indicating urination), the button will light up, audibly say the number and, play a short melody (and the eyes may light up). The product will electronically dispense 4 sheets of toilet paper from the mouth with this trigger. Upon pressing the number 2 (indicating a bowel movement), the button will light up, audibly say the number and play a short melody (and the eyes may light up). The product will electronically dispense 7 sheets of toilet paper from the mouth with this trigger. Upon pressing the number three (indicating extended usage), the button will light up, audibly say the number and play a short melody (and the eyes may light up). The product will electronically dispense another few sheets of toilet paper upon this trigger. Final sheet count to be determined in testing. To control overuse of the toilet paper, additional button pushes beyond the three indicators within the user's time period will trigger the dispenser to temporarily look. After a couple minutes of undetected motion or button pushes, the dispenser will unlock and reset itself for the next user.

Figure 3:
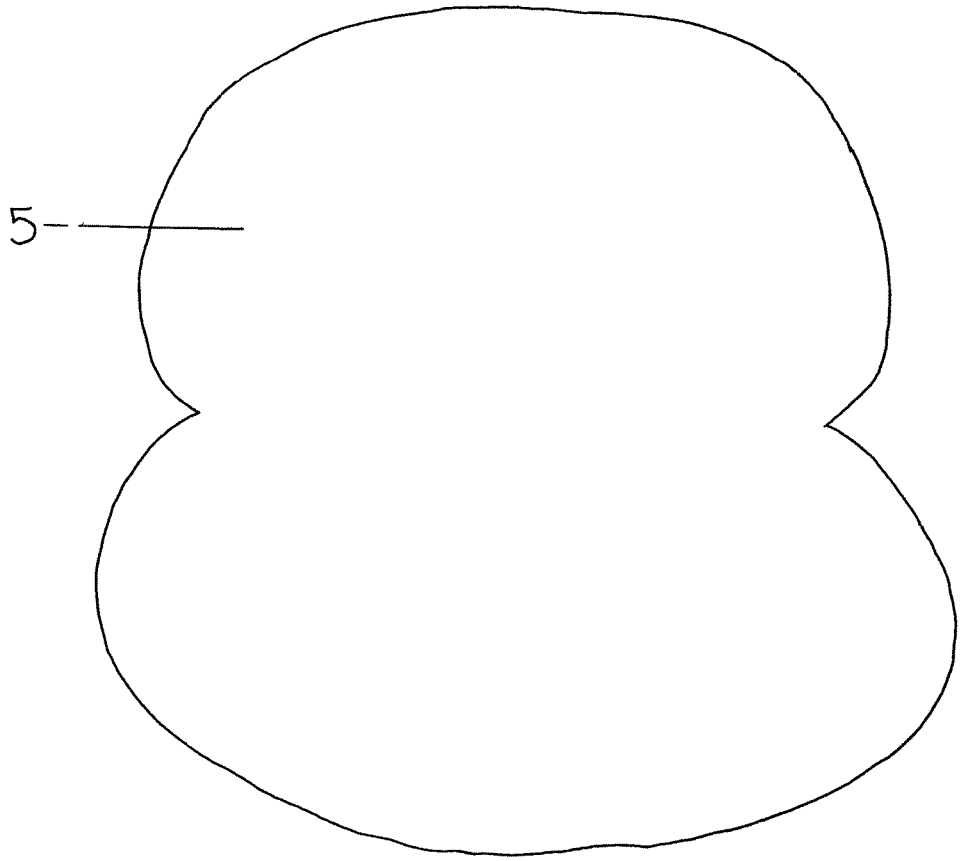
FIG. 3.—illustrates the BACK view of the product top (or head).

FIG. 3 shows the back panel of the product top (or head). Preferably, this area of the product will not contain any functional parts, buttons, compartments or interface. This can, however, serve as an alternate location for power and audio function buttons or battery compartment if necessary based on internal electronics and toilet paper mounting.

Figure 4:
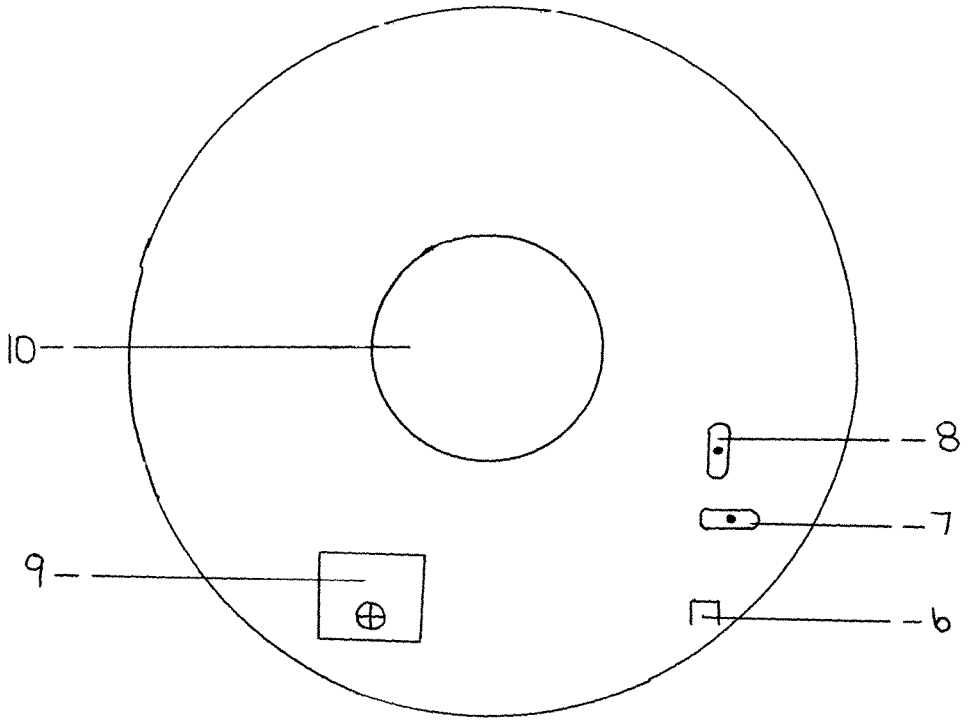
FIG. 4.—illustrates the BOTTOM view of the product top (or head) which serves as the battery and preferences panel.

FIG. 4 illustrates the bottom view of the product top (of head) which serves as the preferences panel of the product. It is here, that the user will find the power on/off button (6), language switch (7), audio on/off switch (8), battery compartment (9) and lastly, the stand insert compartment (10) where the stand can be attached to the top (or head) of the product.

Powering the product on and off requires only a single button (6) indicator. Hold the button to the right in ON position, and the product will come on, triggering the motion sensor readiness, as well as, lights and sounds. The product will also contain an auto-sleep mode feature if the product detects no motion or interaction for more than 10 minutes. Total minutes on final product pending testing. To permanently power off the device, the user must hold down the power button to the left in OFF position.

The product will offer two language options, English and Spanish, for users. In order to choose the language, the user must push the language switch left or right (7). The switch must remain in this position to experience any spoken words or song lyrics in the preferred language. Upon removing the product from the box, the default language will be English.

Next, to the audio controls. The product will have a preset volume level that has been tested for quality audio standards and safety for children. However, a user does have the option to mute all audio coming from the device. Similar to the language control, the user must push the switch (8) left or right to indicate whether they want sound or not. The switch must remain in this position to enable or disable the audio feature. Note, there is no control for the lights or motion sensor. Those are always functioning to indicate the product is working and to trigger dispenser functionality.

To power the device, the preference is to use a Lithium 3V battery (or similar battery). This battery has been chosen due to lithium batteries being known for long shelf life, low temperature operation, high operating voltage and leakage resistance, which are all important factors for a child's product. For better protection, the battery compartment can only be accessible by using a Phillips head screwdriver. With said screwdriver, the user can open the compartment, remove the small cover, add or replace the battery and lock the lid back in place. Other battery types will be considered at build based on final electronics requirements.

The underside of the top (or head) will also contain the stand insert compartment (10). This will be an empty, round compartment approximately 1-inch-deep that will allow the stand to be attached.

Figure 5:
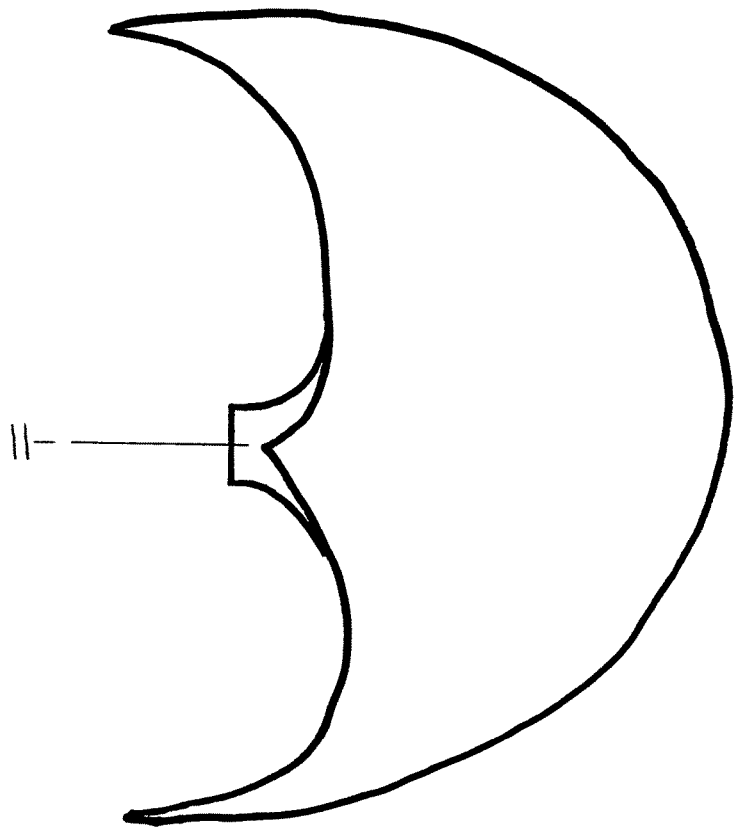
FIG. 5.—illustrates the SIDE view of the product top (or head) showing the hinging system and open/close mechanism.

FIG. 5 illustrates the side views of the product top (or head) showing the open/closure mechanism, as well as the horizontal swing-hinge functionality. When the user wants to open the dispenser, they will press down on a plastic/rubber/foam latch lock (11) located on the right (or left) side of the device. By pressing the latch inward, the compartment will unlock and detach from the other side, allowing the user to look inside. This latch will be built with child safety in mind to ensure that a child cannot get into the unit or injure themselves trying to open. On the opposite side of the head will live the swivel hinges (2 sets, upper and lower). These will allow the head pieces to remain intact, but provide a full, horizontal range of motion (180°) to open the cabinet. To close, the user will push the two halves back together and the clasp should snap back into place, locking the device.

Figure 6:
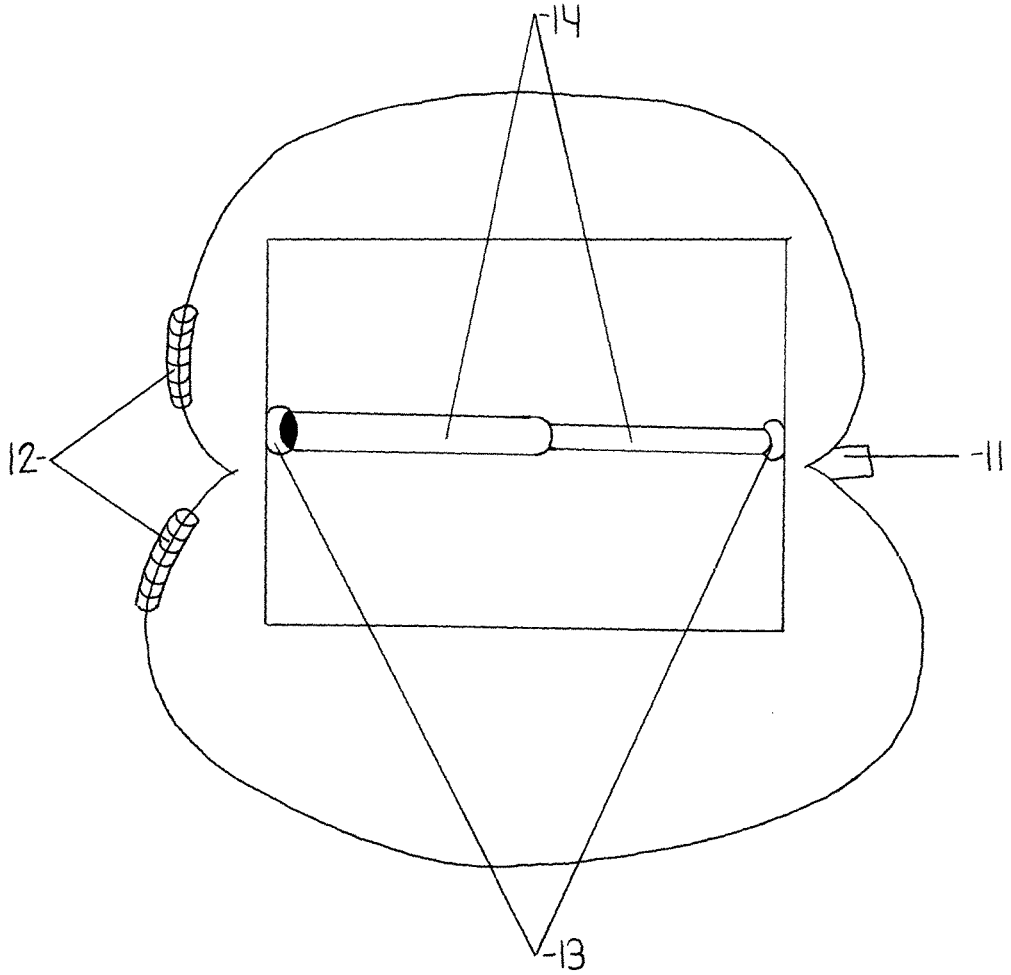
FIG. 6.—illustrates the INTERNAL views of the product top (or head) which will house the toilet paper holder and mechanical parts.

FIG. 6 shows the internal view of the product top (or head), otherwise functioning as the component housing. Securely locked with said latch system noted in FIG. 5, this area of the product will house all components that control interactive and mechanical functionality, including—the motorized toilet paper holder (14) and toilet paper roll, all electrical/mechanical wiring and gears for dispensing the toilet paper, all electrical/mechanical components for motion sensors and lights (eyes), as well as, all electrical components and parts needed for the audio speakers (2). Preferably, all motorized and electrical functions and parts will remain in the front (or facial) compartment of the product cabinet (or head). Preferably, the back compartment of the product cabinet will remain an empty cavern, which will allow extra space and breathing room for the parts to fit. Further testing and build will determine if any parts must be moved to the back compartment for proper functionality or safety reasons.

As previously mentioned, the head will house two eyes (1), which will contain the motion sensor within the pupil areas, while the whites of the eyes will contain flashing, multicolored lights. Also in this compartment are small audio speakers (2), which will be placed directly behind the 4 freckles on each cheek of the face and will play melodies when prompted. Just below these components, will be the toilet paper holder compartment (13), containing the space where the toilet paper roll can fit, as well as, the toilet paper roller (14) onto which the toilet paper itself will live. The toilet paper holder compartment will house 2 holes, one on each side (left and right) of the device. This is where the toilet paper roller will snap into place. The toilet paper roller will be built to industry standard roller specs. Device will have the ability to hold the standard sized (4.5"×4.5") toilet paper roll. There will be a small opening (seen outside as the mouth), where the toilet paper will exit during interaction. The user will partially feed the starter sheet through the opening (guided by a small plastic piece), therefore allowing the paper to continue flowing through ongoing.

Further detail of the overall mechanics and electronics are TBD based on additional discussions with an engineering team. These discussions will determine the specific inner workings of the device as it relates to motion detection, button triggers, automatic toilet paper sheet distribution and audio component functionality.

Figure 7:
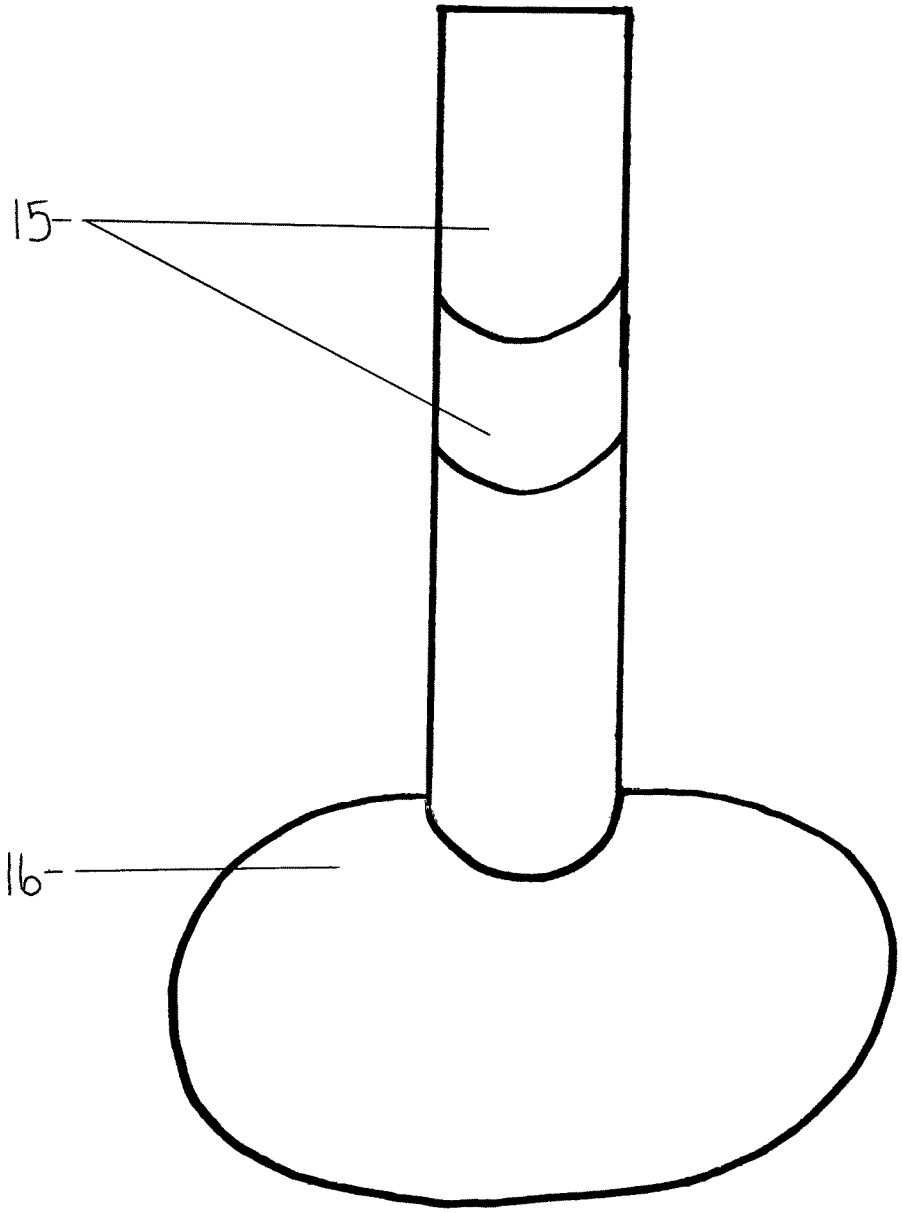
FIG. 7.—illustrates the perspective view of the adjustable stand and base.

FIG. 7 illustrates the perspective view of the height controllable stand and removable base. As seen in FIG. 6, the stand (15) will connect to the underside (10) of the top (or head) of the product and will be made of two poles—an inner pole (approx. 16" long) and outer pole (approx. 17" long). For stability and security, the pole stand will reside in a rounded stabilizer base. The base will have a cutout approximately 1-2 inches deep to allow for the pole stand to securely and safely be placed upright. The base will be heavy, wide and strong enough to stabilize device when fully assembled.

Upon removal from the box, the two poles will already be assembled (one within the other) and will stand approximately 17-18" in length. The user will first insert the pole stand into the base and secure with screws. Next, the user will attach the head to the top of the pole stand. To adjust the height of the device, based on the seated height of the child, the user must twist the clutch, lift the pole to the desired height, and tighten the clutch to hold. The adjustment ranges from 17"-32" fully extended. When the device is not in use, it can either remain and be placed to the side or, all parts (head, pole stand, base) are easily detachable for disassembly and compact storage.

Additional considerations include a storage case for housing when the product is not in use. As well as, an assortment of colors and finishes.

Having described our invention, we claim:

1. An electronic toilet paper dispenser for children that will allow for automated distribution of toilet paper in a selected amount comprising:

a. a control device; a power button; a language switch; audio switch; a secure battery compartment and cabinet housing for housing a toilet paper roll and automated dispensing device;

b. a height adjustable stand including a stabilizer base and a pole;

c. a motion sensor configured to detect the presence of a user in order to begin automated interactive system controls including a flashing colored light system; audio speakers for playing music and sounds;

wherein selection of toilet paper amount can be determined by detected motion by said motion sensor or by button selection for automated distribution of the selected amount.

* * * * *